US005208073A

United States Patent [19]

Yoshino

[11] Patent Number: 5,208,073

[45] Date of Patent: May 4, 1993

[54] METHOD OF MANUFATURING A COLORED METALLIC SHEET

[75] Inventor: Akira Yoshino, Osakayama, Japan

[73] Assignee: Daidousanso Co., Ltd., Osaka, Japan

[21] Appl. No.: 769,703

[22] Filed: Oct. 2, 1991

[30] Foreign Application Priority Data

Jan. 22, 1991 [JP] Japan ..... 3-22986

[51] Int. Cl.[5] ..... B05D 3/02

[52] U.S. Cl. ..... 427/318; 134/31; 156/646; 156/664; 427/327

[58] Field of Search ..... 134/31; 156/646, 655, 156/656, 664, 665; 427/327, 318

[56] References Cited

U.S. PATENT DOCUMENTS 4,296,151 10/1982 Bouitinghouse ..... 427/255.1
4,975,147 12/1990 Tahara et al. ..... 156/664 X

FOREIGN PATENT DOCUMENTS 0352061 1/1990 European Pat. Off. .
0408168 1/1991 European Pat. Off. .
2925995 1/1980 Fed. Rep. of Germany .

*Primary Examiner*—Michael Lusigan
*Attorney, Agent, or Firm*—Armstrong, Westerman, Hattori, McLeland & Naughton

[57] ABSTRACT

In this invention, a method of manufacturing a colored metallic sheet comprises steps of holding a surface to be painted of metallic plates 10 in a fluorine- or fluoride-containing atmosphere in a heated condition to form a fluorided layer on the surface to be painted, removing the formed fluorided layer on the surface just before painting the surface to expose a metallic base, and painting the exposed metallic base surface.

1 Claim, 1 Drawing Sheet

METHOD OF MANUFATURING A COLORED METALLIC SHEET

TECHNICAL FIELD

This invention relates to a method of manufacturing a colored metallic sheet or plate.

PRIOR ART

Recently a colored metallic sheet or plate such as a colored iron sheet is applied to various articles such as an automobile chassis, a roof plate like a colored galvanized sheet, a wall plate or the like of a shed. Materials for these metallic plates include various materials such as mild steel, stainless steel and aluminium. In manufacturing such a colored metallic plate, painting such as electrodeposition, and roller coating is conducted in a painting process which is a final process to a metallic sheet molded in a rolling process and the like after pretreatments such as degreasing and descaling.

In the above method, however, an oxide film or layer on the surface of the metallic sheet, which comprises oxides such as Fe, Si, Mn and Cr, oxides can not be removed completely from the surface in the pretreatment during the painting process. Consequently some of the oxide layer on the metallic plate surface remains. Because of this, even if painting is conducted on such a surface of the metallic sheet, it is difficult for the paint to adhere to the oxide layer remained portion, whereby peeling-off of the painted coat is caused.

OBJECT OF THE INVENTION

Accordingly, it is an object of this invention to provide a method of manufacturing a colored metallic sheet or plate wherein the surface of the metallic sheet to be painted is cleaned and activated in order that the paint easily adheres to the treated surface in a subsequent painting process, and that a problem of peeling-off of the painted coat is prevented.

DISCLOSURE OF THE INVENTION

To accomplish the above-mentioned object, the method of manufacturing a colored metallic plate comprises the steps of holding a surface of a metallic plate to be painted in a fluorine- or fluoride-containing atmosphere in a heated condition to form a fluorided layer on the surface to be painted, removing the formed fluorided layer on the surface just before painting the surface so as to expose a metallic base, and painting the exposed metallic base surface.

That is, in the method of producing a colored metallic sheet according to the invention, a surface of the metallic plate to be painted is held in a fluorine- or fluoride-containing gas atmosphere in a heated condition prior to painting the sheet. By means of activated fluorine atoms, foreign matter such as processing aid adhered to the surface are destroyed and eliminated so as to clean the surface thereof, and a passive coat layer such as the oxide layer on the surface is converted to a fluorided layer to protect the surface therewith. The fluorided layer is stable under the temperature at about 300° to 600° without $H_2$ and $H_2O$ to prevent an oxide layer formation on a metallic base and an adsorption of $O_2$, until subsequent removal of the fluorided layer. Just before painting, for example, $H_2$ gas or a trace amount of $H_2O$ is sprayed to the surface for decomposing-/removing the fluorided layer to thereby expose the metallic base. The exposed surface is cleaned and activated, so that the paint easily adheres thereto in the following painting process, and it prevents peeling-off of a painted coat from the painted surface.

This invention is described in detail as follows.

The term "fluorine- or fluoride-containing gas" as used in the present invention means at least one fluorine source component, selected from among $NF_3$, $BF_3$, $CF_4$, HF, $SF_6$, $F_2$, $CH_2F_3$, $C_2F_6$, $WF_6$, $CHF_3$, $SiF_4$ and the like is contained in an inert gas such as $N_2$. Among these fluorine source components, $NF_3$ is most suitable for practical use since it is superior in reactivity, ease of handling and other aspects to the others.

As the metallic material to compose the metallic plate to be a subject of this invention, there are a steel material, an aluminium material, a titanium material, a nickel material and the like. The material includes not only such a single material but also an alloy which is composed of the above-mentioned materials at an appropriate ratio or which is composed of the above-mentioned materials as a main composition and other metallic materials.

In this method of the invention, as mentioned before, a surface of a metallic sheet to be treated is held in said fluorine- or fluoride-containing gas atmosphere in a heated condition, for example, in the case of $NF_3$, at 250° to 400° C. to fluorinate the surface. After the fluoriding, the fluoride film is removed from the surface by spraying $H_2$ gas or a trace amount of $H_2O$ prior to painting or coating the surface to expose the metallic base, and an objective colored metallic plate can be obtained by painting the exposed surface. In such fluorine- or fluoride-containing gas, the concentration of the fluorine source component, such as $NF_3$, should amount to, for example, 1,000–100,000 ppm, preferably 20,000–70,000 ppm, more preferably 30,000–50,000 ppm. The holding time in such fluorine- or fluoride-containing gas atmosphere may appropriately be selected depending on the species of metallic materials, heating temperature and the like, generally within the range of ten and odd minutes to scores of minutes.

The method of manufacturing a colored metallic sheet according to the invention is described in more detail hereinafter. Metallic plates 10 are charged into a heat treatment furnace 1 shown in the FIG. 1. The furnace 1 is a pit furnace, wherein an inner vessel 4 is located inside a heater 3 disposed in an outer shell 2. A gas inlet pipe 5 and an exhaust pipe 6 are inserted into the inner vessel 4. Gasses are supplied to the gas inlet pipe 5 from a cylinder 14 through a flow meter 15, a valve 16 and the like. The inside atmosphere is stirred by a fan 8 rotated by a motor 7. The metallic plates 10 contained in a container 11 are charged into the furnace. In the FIG. 1, reference numeral 9 indicates pedestals of the metallic plates 10, 12 a vacuum pump and 13 a noxious substance eliminator. A fluorine- or fluoride-containing gas, for example, a mixed gas composed of $NF_3+N_2$ is fed into the inner vessel 4 of the furnace 1 from the cylinder 14 through the flow meter 15, the valve 16 and the gas inlet pipe 5 and is heated by the heater 3 to the predetermined reaction temperature. At temperature of 250°–400° C., $NF_3$ gas evolves fluorine in the form of an active group, whereby processing aids and organic and/or inorganic contaminants adhered to the surface of the metallic plates 10 are eliminated and this fluorine rapidly reacts with the oxides such as FeO, $Fe_3O_4$ and $SiO_2$ as shown in the following equations. As a result, a very thin fluorinated layer containing such compounds as $FeF_2$, $FeF_3$ and $SiF_4$ in its composition is formed on the surface of the metallic plate 10.

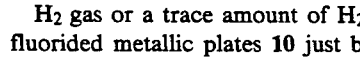

$$FeO+2F \rightarrow FeF_2+\tfrac{1}{2}O_2$$

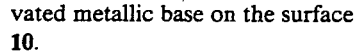

$$SiO_2+4F \rightarrow SiF_4+O_2$$

These reactions convert the oxidized layer on the surface of the metallic plate 10 to a fluorinated layer and remove $O_2$ adsorbed on the surface. When $H_2$ and $H_2O$ are absent, such fluorinated layer is stable at temperature not more than 300 to 600° C. and can prevent formation of an oxidized layer and an adsorption of $O_2$ until the subsequent removal of a fluorided layer. In such fluoriding treatment, a fluorinated layer is formed on a furnace material surface at the first step and minimizes the damage thereto caused by the $NF_3$ gas.

$H_2$ gas or a trace amount of $H_2O$ is sprayed on the fluorided metallic plates 10 just before painting. As a result, the fluorinated layer is deoxidized or destroyed according to the following equations to expose an activated metallic base on the surface of the metallic plates 10.

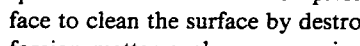

$$2FeF_3+3H_2 \rightarrow 2Fe+6HF$$

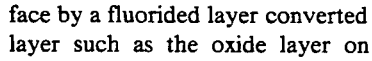

$$SiF_4+2H_2 \rightarrow Si+4HF$$

The required colored metallic sheet/plate can be obtained when thus treated metallic plate surface is painted immediately in that state.

Accordingly, in the present invention, the method comprises steps of holding the surface of the metallic plates 10 in a fluorine- or fluoride-containing gas atmosphere in a heated condition prior to painting the surface to clean the surface by destroying and eliminating foreign matter such as processing aid adhered to the surface with activated F atoms and to protect the surface by a fluorided layer converted from a passive coat layer such as the oxide layer on the surface to be painted. Just before painting, for example, $H_2$ gas or a trace amount of $H_2O$ is sprayed on the surface of the metallic plate 10 for decomposing/removing the fluoride layer to expose the metallic base, so that the paint is easily adhered thereto in the following painting process and peeling-off of a painted coat from the painted surface is prevented.

In the above description, $H_2$ gas or a trace amount of $H_2O$ is sprayed just before painting, but this invention is not limited to it. It is possible to conduct a phosphate coating treatment to the metallic base in order to strengthen adhesion property of a painted coat and to improve anti-corrosion property. In this case, the anti-corrosion property may further be improved by conducting an after-treatment with a water solution of chromic acid to reinforce said phosphate coat.

Figure 1:
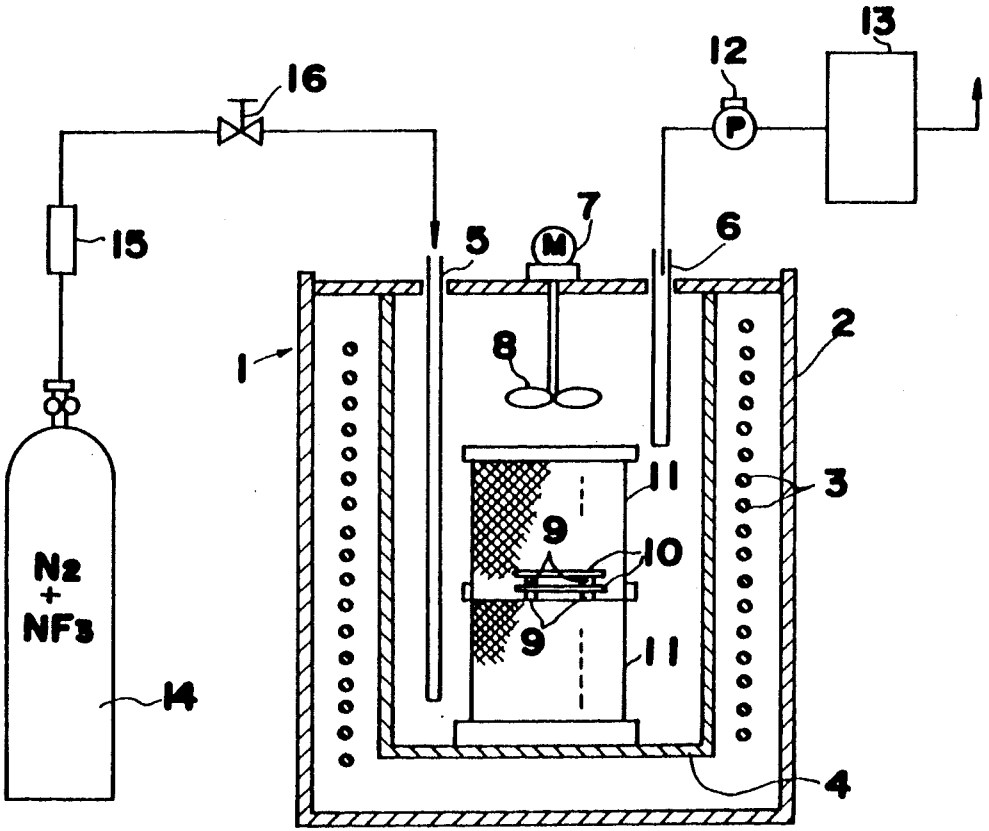
FIG. 1 shows a cross-sectional view of a heat treatment furnace used in an example of the present invention.

Followings are descriptions of embodiments.

EXAMPLE 1

Iron plates 10 were held in N, gas atmosphere containing 5000 ppm of $NF_3$ at 300° C. for 15 minutes within the heat treatment furnace 1 as shown in FIG. 1. Just before painting the plates 10, $H_2$ gas was sprayed uniformly thereto. Then the plates were painted. Peeling-off of the painted coat was not caused on the obtained colored plate even if a certain period has passed (no peeling-off was found after 2,000 hours in a weather-ometer test).

EXAMPLE 2

Iron plates 10 were held in N, gas atmosphere containing 5000 ppm of $NF_3$ at 300° C. for 15 minutes within the heat treatment furnace 1 as shown in FIG. 1. Prior to painting, $H_2$ gas was sprayed to the plates 10 uniformly, and a phosphate coating treatment and an after-treatment by a water solution of a chromic acid were conducted thereto. Then the plates were painted. Peeling-off of the painted coat was not caused on the obtained colored plate even if a certain period has passed (no peeling-off was found after 2,000 hours in a weather-ometer test).

EFFECT OF THE INVENTION

As mentioned above, in the method of manufacturing a colored metallic sheet of the present invention, the surface to be painted of a metallic sheet/plate is held in a fluorine- or fluoride-containing gas atmosphere in a heated condition prior to painting. By this treatment, adhered foreign matter such as processing aid are eliminated to clean the surface, and a passive coat layer such as the oxide layer on the surface is converted to a fluoride layer to protect the surface. Therefore, in case of having a long interval in time from the fluorided layer formation to its removal, the fluorided layer formed on the surface protects the surface to be painted in a good state to prevent oxide layer reproduction. This fluorided layer is decomposed and eliminated from the surface just before painting to expose the metallic base. Because painting is conducted on the exposed surface, the paint easily adheres to the surface. Accordingly, a colored metallic sheet without causing peeling-off of the painted coat can be obtained.

What is claimed is:

1. A method of manufacturing a colored metallic sheet comprising the steps of holding a surface of a metallic plate to be painted in a fluorine or fluoride-containing atmosphere in a heated condition to form a fluoride layer on the surface to be painted, removing the formed fluoride layer from the surface just before painting the surface so as to expose a metallic base, and painting a surface of the exposed metallic base.

* * * * *